US008181376B2

(12) United States Patent
Rietveld

(10) Patent No.: US 8,181,376 B2
(45) Date of Patent: May 22, 2012

(54) FLOOR DISPLAY

(75) Inventor: Matthijs Alphons Rietveld, Aw Den Haag (NL)

(73) Assignee: Comax B.V., Delfi (NL)

( * ) Notice: Subject to any disclaimer, the term of this patent is extended or adjusted under 35 U.S.C. 154(b) by 461 days.

(21) Appl. No.: 11/568,184

(22) PCT Filed: Apr. 20, 2005

(86) PCT No.: PCT/NL2005/000293

§ 371 (c)(1),
(2), (4) Date: Oct. 20, 2006

(87) PCT Pub. No.: WO2005/104069

PCT Pub. Date: Nov. 3, 2005

(65) Prior Publication Data

US 2007/0193100 A1 Aug. 23, 2007

(30) Foreign Application Priority Data

Apr. 22, 2004 (NL) ..... 1026008

(51) Int. Cl.
*G09F 1/00* (2006.01)

(52) U.S. Cl. ..... 40/790; 40/772; 40/654.01

(58) Field of Classification Search ..... 40/790, 40/791, 654.1, 638, 359, 661
See application file for complete search history.

(56) References Cited

U.S. PATENT DOCUMENTS

| | | | | |
|---|---|---|---|---|
| 5,787,627 | A * | 8/1998 | Snoke et al. | 40/791 |
| 6,615,526 | B2 * | 9/2003 | Pitcher et al. | 40/790 |
| 6,742,296 | B2 * | 6/2004 | Johnson et al. | 40/790 |
| 2002/0028313 | A1 | 3/2002 | Gentiluomo et al. | |

FOREIGN PATENT DOCUMENTS

| | | |
|---|---|---|
| EP | 0 857 028 | 8/1998 |
| GB | 2 200 384 | 8/1988 |

* cited by examiner

*Primary Examiner* — Casandra Davis
(74) *Attorney, Agent, or Firm* — Thomas R. Vigil

(57) ABSTRACT

A floor display comprises a window plate (2) made from a transparent material, a baseplate (3), and a frame made from flexible material, the frame (4) extending around the two plates (2, 3) and holding them together, it being possible for an exchangeable image carrier (21) made of material in sheet or film form to be placed between the plates (2, 3), the frame (4) being nonreleasably connected, by means of a bonded join, to substantially the entire peripheral edge (9) of the window plate (2), and the frame (4) furthermore being non-releasably connected, by means of a bonded join, to at most two peripheral edge sides (10) of the baseplate (3).

20 Claims, 8 Drawing Sheets

FLOOR DISPLAY

CROSS-REFERENCE TO RELATED APPLICATION

This application is the National Stage of International Application no. PCT/NL2005/000293 filed Apr. 20, 2005, which claims the benefit of Netherlands application number 1026008 filed Apr. 22, 2004, the contents of which are incorporated by reference herein.

FIELD OF THE INVENTION

The invention relates to a floor display, in particular an interchangeable picture frame for placing on the floor.

BACKGROUND OF THE INVENTION

A number of years ago, the Applicant discovered the unexploited possibilities of the floor as an advertising or information surface. To remedy this deficiency, at that time he developed a display which is commercially available under the name FloorWindo.

The FloorWindo is a flat interchangeable picture frame for posters intended to be laid on a floor, in particular on a shop floor. If necessary, a shopping trolley can be pushed over it without the display or image carrier being visibly damaged. Floor advertising in this form has a number of characteristic benefits. It is striking and in principle does not take up any space. Since it can be positioned as desired, advertising can be placed close to the corresponding product, where the customer takes the definitive decision to purchase, known as the point of purchase or point of sale. Various tests have demonstrated that floor advertising is extremely well perceived by the shopping public and increases the sale of the recommended products significantly.

The demands imposed on flat image carriers of this type are high, including the resistance to the heavy loads caused, for example, by the shopping public or the shop staff with pallet trolleys and the protection of the poster from moisture and dirt. In addition, the display also has to be user-friendly and maintenance-friendly and must rest on the base such that it cannot slip.

In addition to the FloorWindo, various alternatives have been devised for floor advertising, including floor stickers. However, stickers have the drawbacks of not being reusable, that it is a specialist job to apply them to the floor, in particular the edges and corners of the product are susceptible to wear, and once the stickers have been removed they can leave behind residues of adhesive on the floor, which are difficult to remove.

A floor display is also known from EP 0 857 028. FIG. 3 of this document shows an embodiment in which the floor display comprises a window plate and a baseplate. The window plate is bonded to a frame of a flexible material over the entire periphery, while the baseplate is held releasably by the frame by means of a positive lock. The frame to this end comprises a clamping edge. During production, the window plate and the baseplate are together placed in a mould, where the flexible frame is moulded on such that it bonds to the window plate but not to the clamping edge of the baseplate, over the peripheral edge of the latter. A suitable choice of material for the respective plates in this case ensures that the frame is bonded to the window plate but is not bonded to the baseplate during the injection-moulding process.

One drawback in this context is that the ease of use leaves something to be desired. For example, exchanging an image carrier between the plates is difficult and takes up a relatively long time. In addition, two different plate materials have to be used, each with different characteristics, in particular different bonding properties, and possibly also different expansion coefficients. This means that it is necessary for a relatively wide frame to be moulded on in order to be able to ensure dust-proof and watertight enclosure of the releasable baseplate. This problem is exacerbated if the dimensions of the display increase, for example, to Al format, which is often used in floor displays. One drawback with the clamping retaining of the baseplate is that with relatively great lengths, such as in the said floor displays, the frame with clamping edge also has to be relatively high, in order to be able to offer sufficient resistance to the relatively high forces which are exerted on the plates and the frame, for example by people walking over the display or shopping trolleys being pushed across it or when the display is being picked up. For this purpose, the frame also has to be made from a sufficiently rigid material. The required rigidity of the frame is, however, disadvantageous when an image carrier is being exchanged. After all, the baseplate for this purpose has to be removed from the relatively rigid clamping edge and then fitted back behind it after the image carrier has been replaced. In addition, the relatively high hardness of the frame ensures that the resistance of the floor display to slipping on the floor sometimes leaves something to be desired.

Furthermore, U.S. 2002/0139026 has disclosed a floor display in which a window plate is held in place, by means of a positive lock with a clamping edge, by a frame made from a flexible material, while a baseplate is bonded to the frame on only one side of its peripheral edge. An image carrier can be arranged between the plates by the window plate being lifted up while the baseplate remains lying on the floor. During production, inserts prevent the frame material from being bonded to the three peripheral edge sides of the baseplate which are to remain free.

One drawback in this context is that the positive locking of the window plate requires the frame to be even higher and wider and made from an even more rigid material, with all the associated drawbacks described above. In addition, the use of the inserts means that a relatively large opening is created between the frame and the three peripheral edge sides of the baseplate which remain free. This is disadvantageous for dustproofing and watertightness. Furthermore, the plates and the frame can easily be displaced with respect to one another if a person collides with the vertical edge which projects above the window plate. Furthermore, the vertical edge has the drawback that dirt can accumulate behind it and that water and cleaning agents remain present inside the edges after cleaning, and that the corners and edges are difficult to clean.

SUMMARY OF THE INVENTION

It is an object of the present invention to at least partially eliminate the above drawbacks and/or to create a useable alternative. In particular, it is an object of the invention to provide a floor display:

- which is user-friendly;
- an image carrier of which is simple to exchange;
- which is easy to clean;
- which cannot slip on the floor;
- which is not regarded as an obstacle; and
- which provides a good seal against dirt and moisture.

According to the invention, this object is achieved by a floor display, comprising a window plate made from a transparent material, a baseplate and a frame out of flexible material, said frame extending around said window plate and said baseplate and holding them together, it being possible for an exchangeable image carrier made of material in sheet or film form to be placed between said window plate and said baseplate, said frame being nonreleasably connected, by means of a bonded join, to substantially the entire peripheral edge of said window plate, and said frame furthermore being nonreleasably connected, by means of a bonded join, to at most two peripheral edge sides of the baseplate. The floor display thus comprises a window plate made from a transparent material, a baseplate and a frame made from flexible material. The frame is nonreleasably connected to the window plate over substantially the entire peripheral edge, by means of a bonded join, and is also nonreleasably connected to the baseplate on at most two peripheral edge sides by means of a bonded join. This design enables the frame to be produced from a more flexible material and to be made less high and wide. An image carrier can easily be placed between the plates by lifting the window plate with respect to the baseplate. The bonding of the frame on at most two peripheral edge sides of the baseplate creates sufficient freedom to do this.

In one particular embodiment, the frame is advantageously completely moulded onto the plates, both onto that part of the peripheral edge sides of the plates to which the frame is to be bonded, and onto that part of the plates onto which the frame is not to be bonded. This automatically compensates for minor tolerances in the plates, and means that, by virtue of the design, such tolerances no longer play a role in achieving a good seal with respect to dirt and moisture.

The window plate and the baseplate are made from materials which are such that the frame can be securely bonded to them. It is preferable for the plates to be made from substantially the same materials, which are in particular characterized in that they are both securely bonded to the frame material and both have substantially the same expansion coefficient. The plates then advantageously expand to the same extent in the event of fluctuating temperatures, for example when the display is in use, and also while hot-melt material which is to form the frame is being moulded onto the plates.

In a further embodiment, the frame is bonded to the baseplate on two peripheral edge sides. These may be two peripheral edges located opposite one another. However, it is preferable for them to be two adjacent peripheral edge sides. In the case of a substantially rectangular floor display, this provides a high level of stability to the structure yet means that it remains easy to slide an image carrier between the plates. The image carrier may in this case advantageously be pushed all the way to the two bonded edge sides, which then serve as a type of stop edge, so that the image carrier can easily be positioned correctly in the floor display.

In particular, the baseplate has smaller dimensions than the window plate. This ensures that the widow plate is supported on the frame by way of a narrow shoulder of its peripheral edge at the underside. The narrow shoulder may be bonded to the frame, but may also not be bonded to it. The latter option makes it easier to partially fold open the window plate with respect to the baseplate.

More particularly, the peripheral edge sides of the baseplate which are not bonded to the frame tightly adjoin the frame. This is preferably achieved by the frame, during production, being moulded on in an injection-moulding process, with the peripheral edge sides of the plates which are not to be bonded to the frame being provided, prior to the moulding operation, with an agent which does not bond to the frame material, for example vaseline or tape.

An anti-slip profile made from the same material as the frame can advantageously be moulded onto the baseplate. By virtue of the fact that the frame material according to the invention may have a lower hardness, the same can also be true of the non-slip profile. The lower hardness here also increases the non-slip properties. The non-slip profile may advantageously be moulded onto the baseplate in a single operation at the same time as the frame is being moulded on. This saves costs and time.

By virtue of the design according to the invention, the frame and the non-slip profile can advantageously be produced from a material with a hardness lower than 50 Shore A. This has the advantage of a high grip on the floor and good sealing contact between the frame and the unbonded peripheral edge sides of the baseplate.

Further preferred embodiments are defined in the subclaims.

The invention also relates to a method for producing a floor display.

BRIEF DESCRIPTION OF THE DRAWINGS

The invention will be explained in more detail with reference to the appended drawings, in which.

DESCRIPTION OF THE PREFERRED EMBODIMENT

Figure 1:
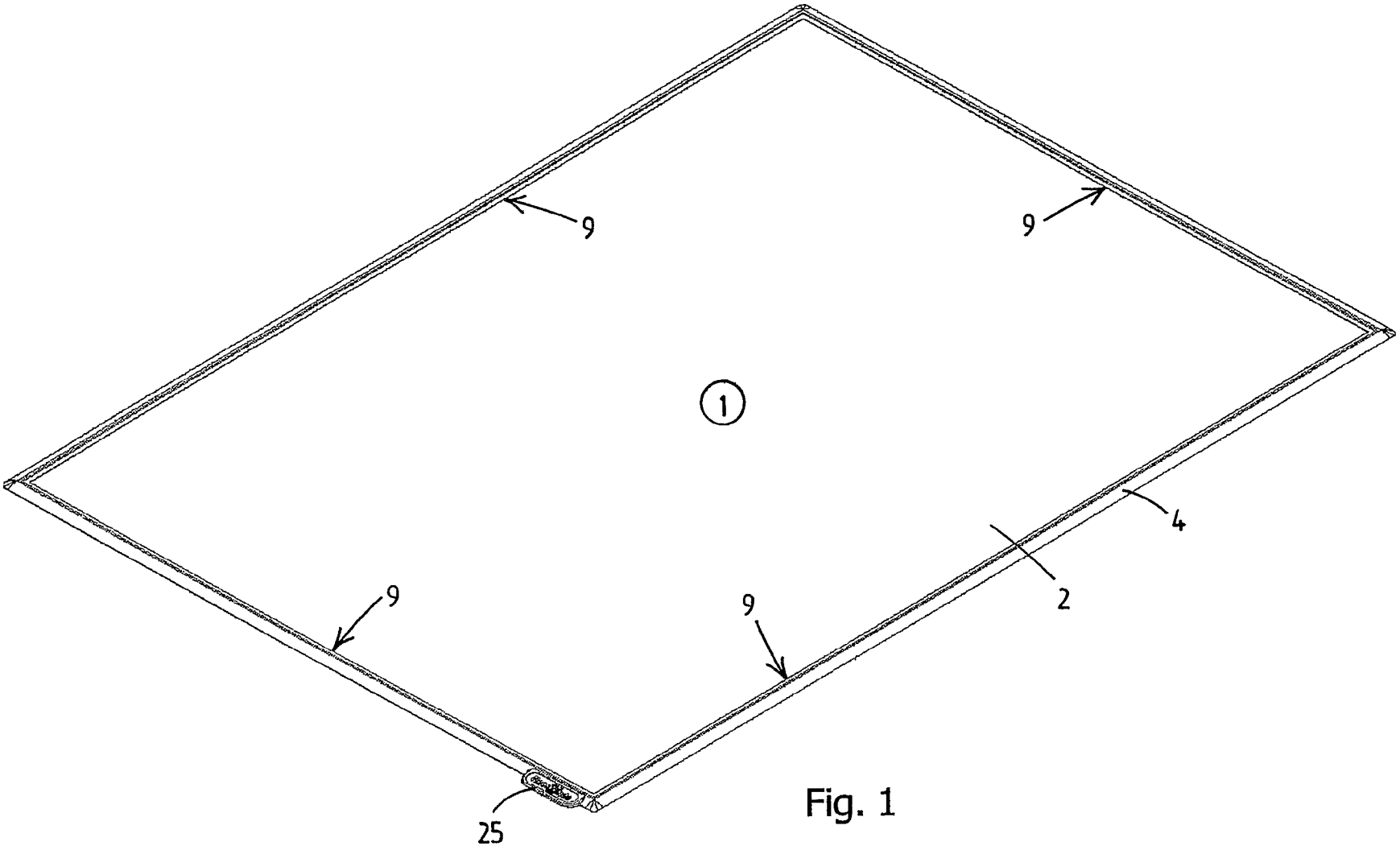
FIG. 1 shows a perspective view of a preferred embodiment of a floor display according to the invention.
Figure 2:
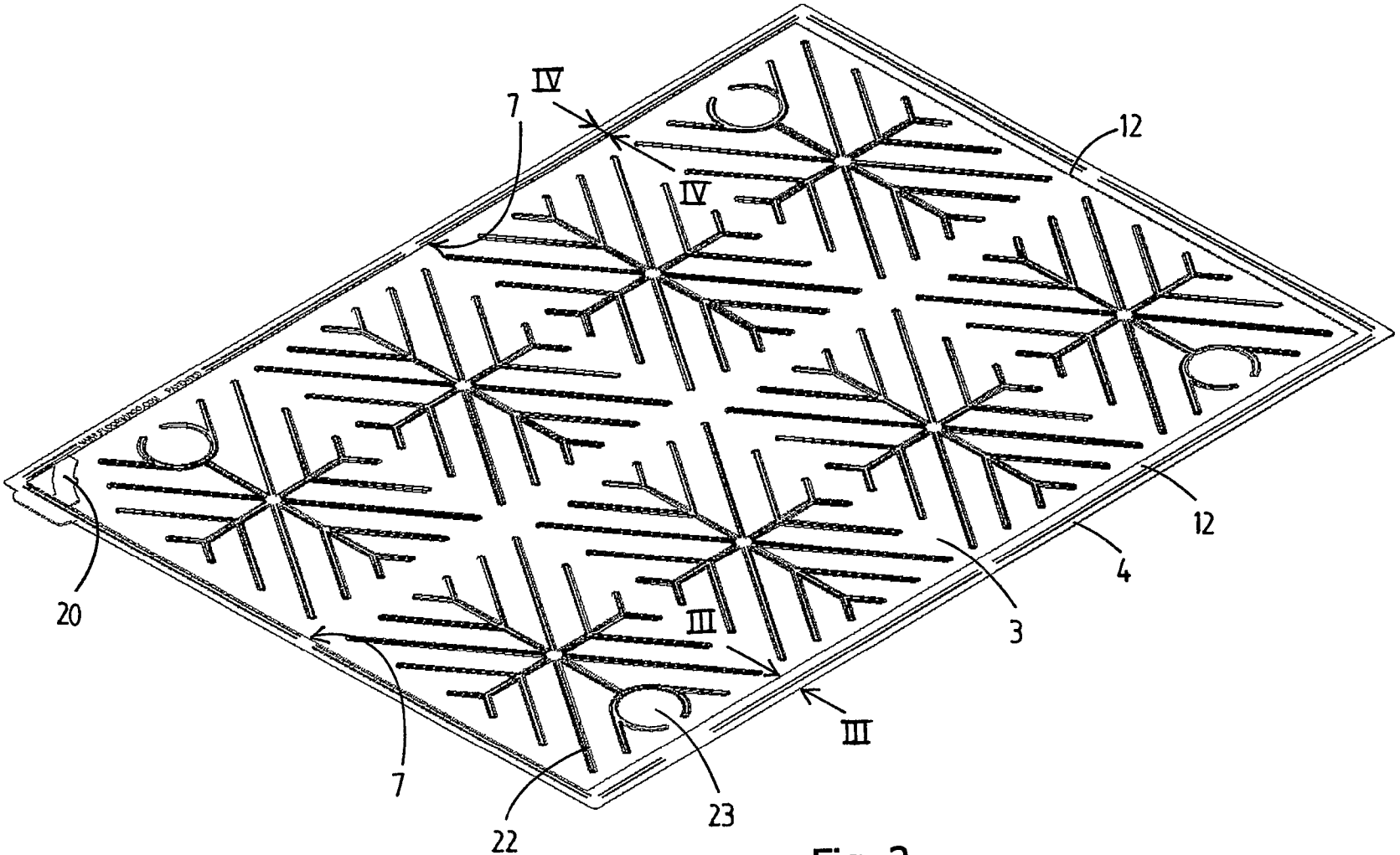
FIG. 2 shows a perspective view of FIG. 1 from below.
Figure 3:
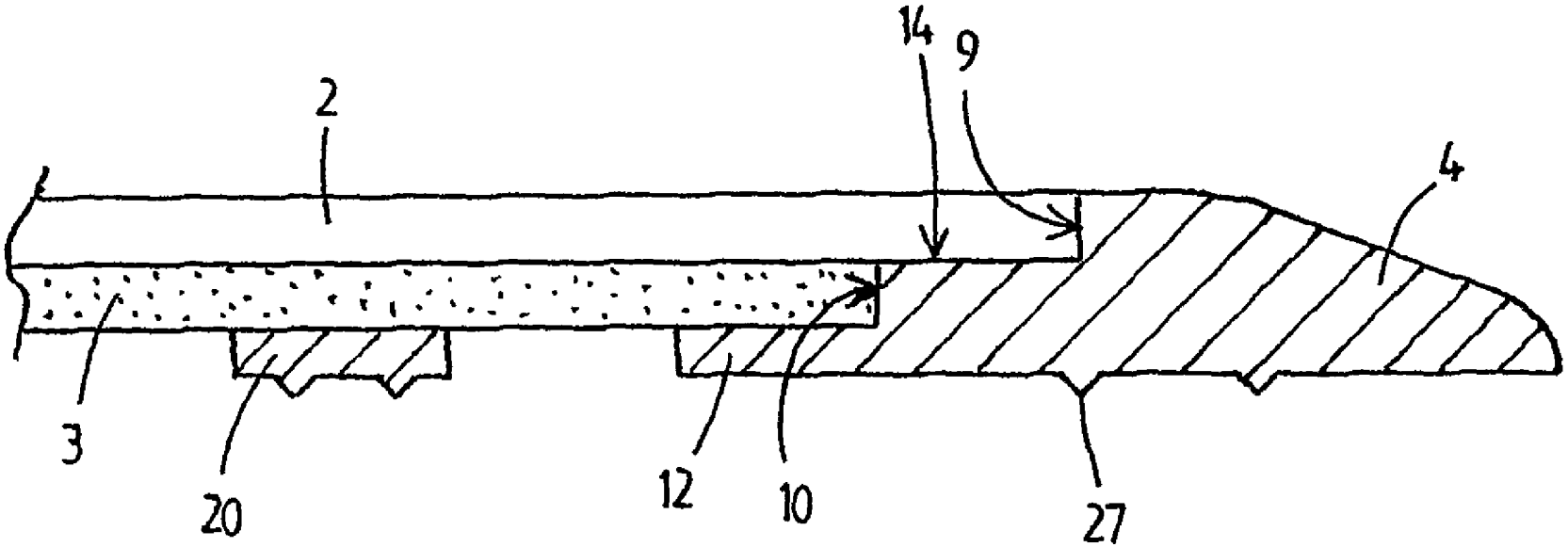
FIG. 3 shows a cross-sectional view on line III-III in FIG. 2.
Figure 4:
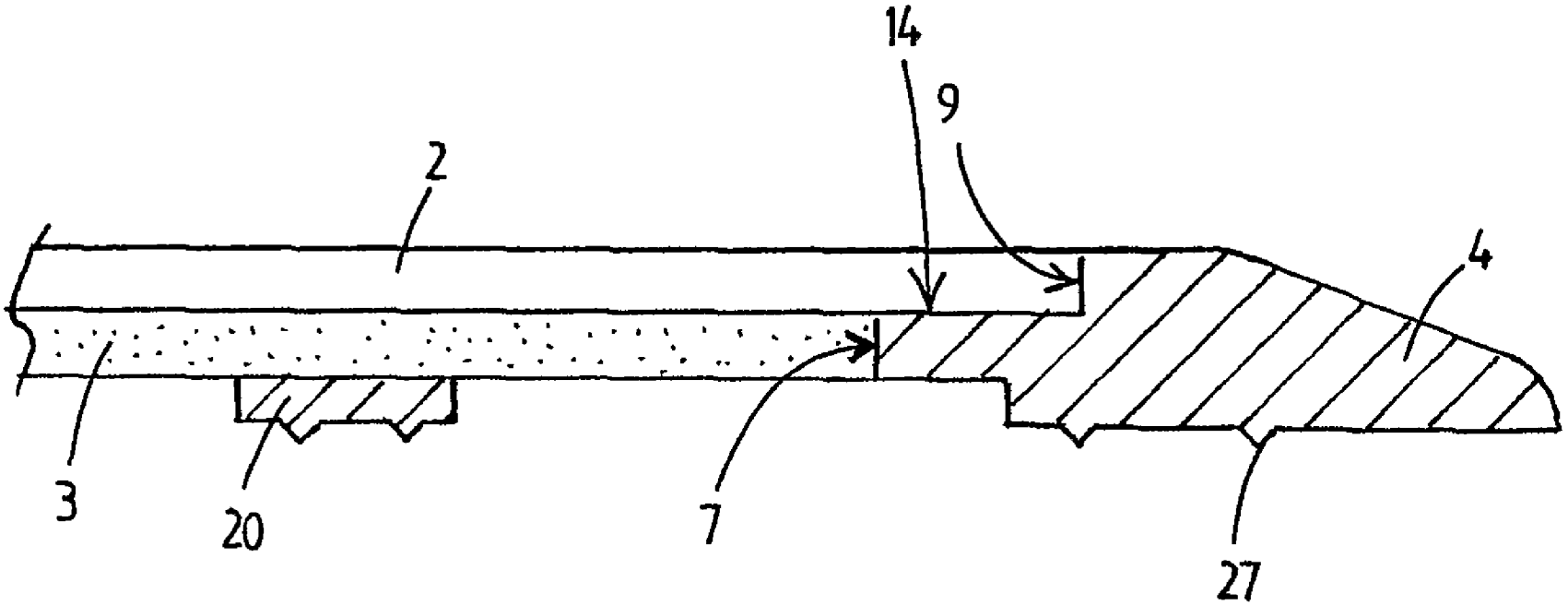
FIG. 4 shows a cross-sectional view on line IV-IV in FIG. 2.

In FIGS. 1-8, the floor display is denoted overall by reference numeral 1. The substantially rectangular floor display 1 comprises a window plate 2, a baseplate 3 and a moulded-on frame 4. The baseplate 3 is designed to be less wide and long than the window plate 2. The materials of the plates 2, 3 are such that the frame material is able to be bonded to the two plates 2, 3 in the molten state and then to set nonreleasably onto it, thereby forming a securely bonded connection.

During production, the two plates 2, 3 are placed into a suitably shaped mould, in which a cavity is left for the frame 4 to be moulded on in an injection-moulding process. In this case, two adjacent vertical peripheral edge sides 7 of the baseplate 3 are provided with an agent that does not bond to the frame material. After the flexile material which is to form the frame 4 has been injected and set, the situation automatically arises whereby the frame 4 is nonreleasably bonded to the entire vertical peripheral edge 9 of the window plate 2, the frame 4 is nonreleasably bonded to two adjacent vertical peripheral edge sides 10 of the baseplate 3, and the frame 4 is not bonded to the remaining two peripheral edge sides 10 of the baseplate 3. The mould cavity in the mould is such that a shoulder 12 is also formed at the location of the bonded vertical peripheral edge sides 10 of the baseplate 3 on the underside thereof. This shoulder 12 is preferably also bonded to the baseplate 3. At the top side, the frame 4 merges seamlessly into the window plate 2, and its top side does not extend beyond the plane of the window plate 2.

The different plate dimensions mean that the window plate 2 is supported on the frame 4 at the underside by way of a shoulder 14 of the peripheral edge. This shoulder can also be bonded to the window plate 2. However, it is also possible for this shoulder 14 to be provided, prior to the injection-moulding process, with an agent which does not bond to the frame material, with the result that it is possible for the frame 4 not to be bonded to the shoulder 14 at that location. This would make it easier to fold open the window plate 2 with respect to the baseplate 3.

The peripheral edge sides 7 of the baseplate 3 which were previously provided with agent that does not bond to the frame material and consequently have not been bonded to the frame 4, adjoin the frame 4 substantially seamlessly. This tightly adjacent arrangement is advantageously obtained automatically during the moulding on of the frame material by virtue of the fact that there is no need to use any inserts to keep the frame 4 clear of a part of the peripheral edge sides of the baseplate 3. As a result, dirt and moisture, despite the absence of a clamping edge, are unable to penetrate between the plates 2, 3.

Figure 5:
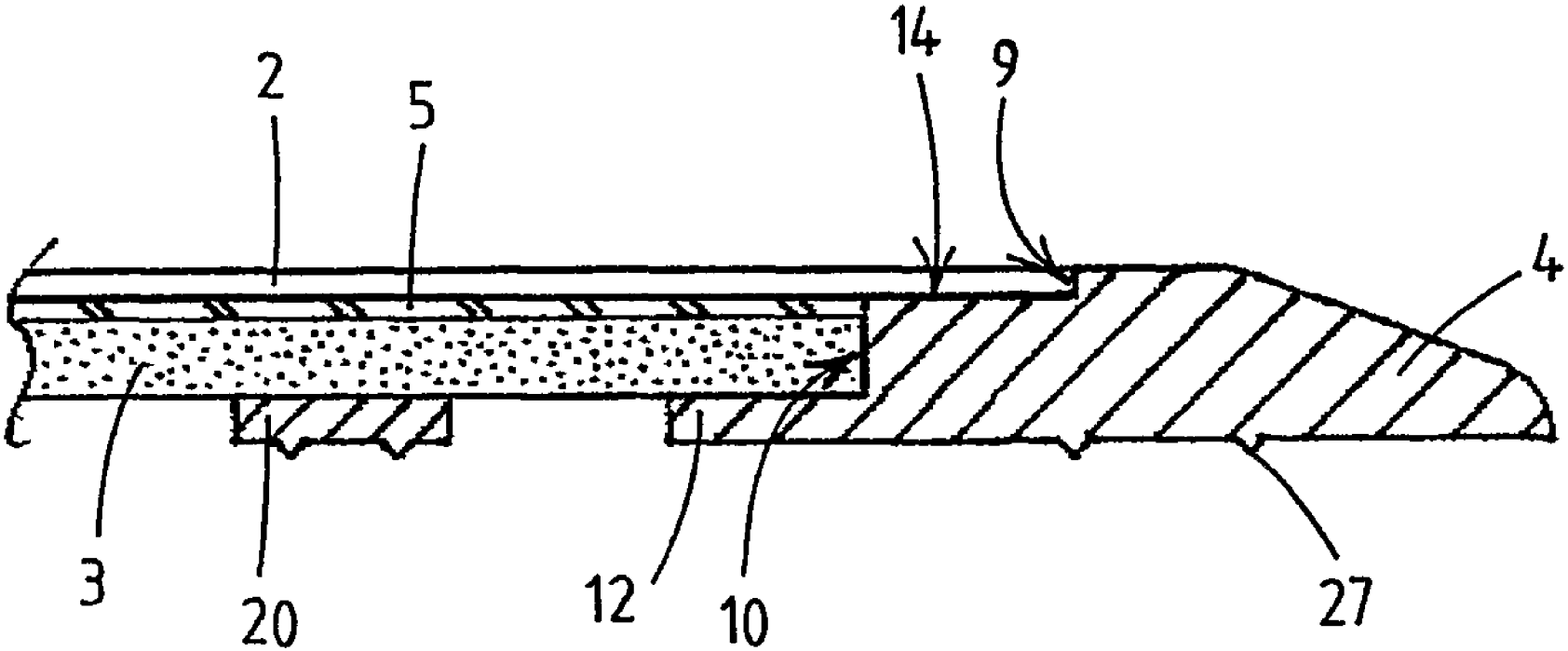
FIG. 5 shows a cross-sectional view on line III-III in FIG. 2 of the floor display in a particular embodiment according to the invention, in which an additional plate has been added.
Figure 6:
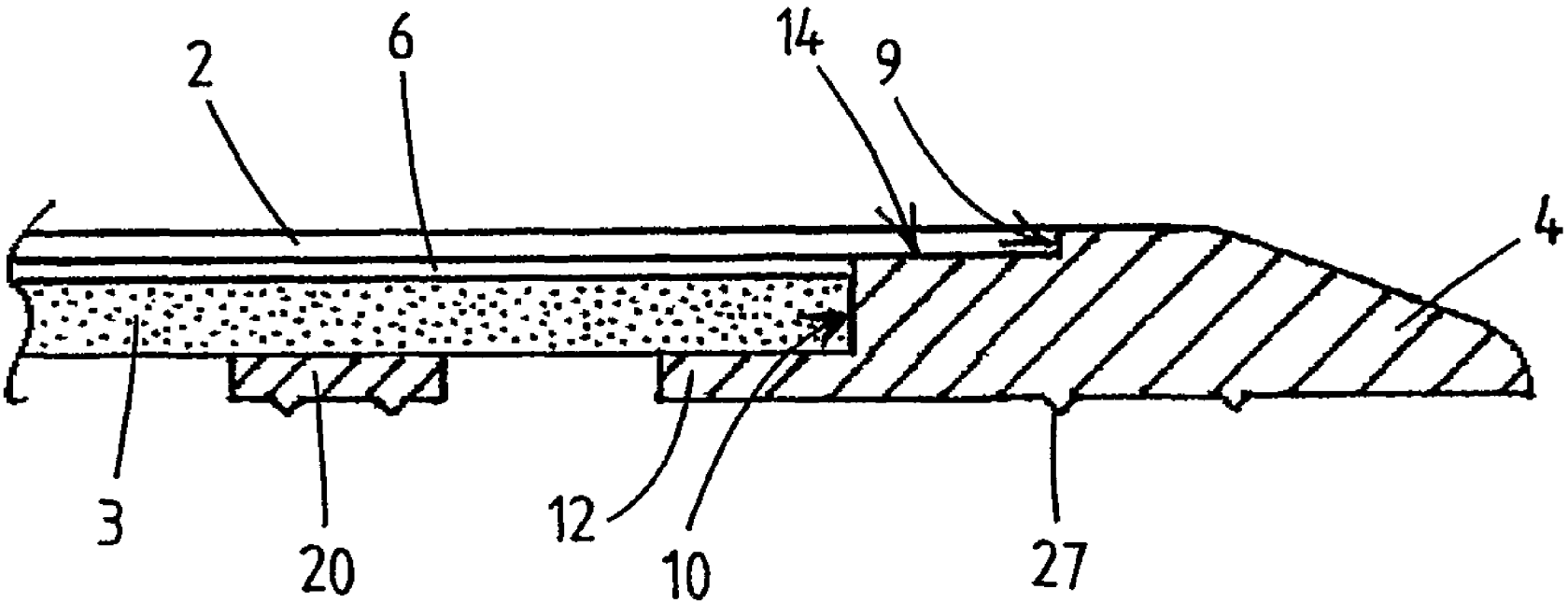
FIG. 6 shows a cross-sectional view on line III-III in FIG. 2 of the floor display in a particular embodiment according to the invention with space between the window plate and the baseplate.

During production, for one particular embodiment of the floor display according to the invention, it is possible to use an additional plate 5. The additional plate 5 is placed in the mould together with the window plate 2 and the baseplate 3 before the frame 4 is moulded on. FIG. 5 shows the additional plate between the window plate 2 and the baseplate 3. The width and length of the additional plate 5 are preferably equal to the width and length of the baseplate 3. The additional plate is in this case thin compared to the baseplate 3. The peripheral edge sides of the additional plate 5 are provided with agent that does not bond to the frame material, so that after the frame 4 has been moulded on, the additional plate is not bonded to the frame 4 and can easily be removed again from between the window plate 2 and the baseplate 3. As an alternative, it is possible to use a plate made from material which does not bond to the frame. As shown in FIG. 6, the removal of the additional plate 5 after the production process leads to the formation of a space 6 between the window plate 2 and the baseplate 3, which can be put to advantageous use in situations in which an image carrier of relatively great thickness is to be inserted. In addition, the space 6 makes it easier to position the image carrier beneath the window plate 2 and slide it all the way to the frame 4, preventing the baseplate 3 from being undesirable visible.

Figure 7:
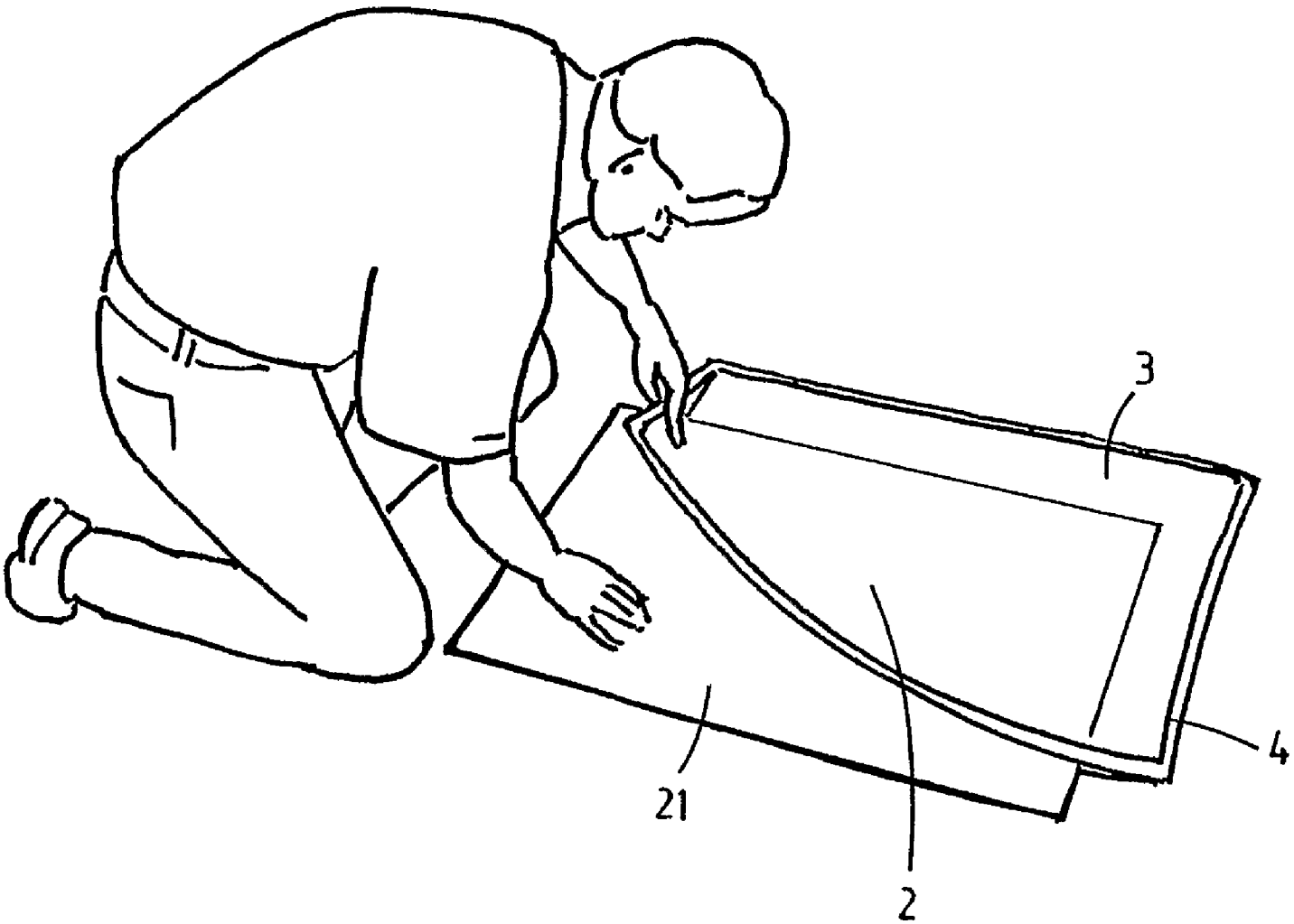
FIG. 7 shows a diagrammatic, perspective view of a proposed way of arranging a poster in a floor display from FIG. 1.

In the corner of the baseplate 3 opposite the two peripheral edge sides 10 which have been bonded to the frame 4, there is a retaining feature 20 which was moulded on together with the frame 4. To ensure that the retaining feature 20 is not bonded to the baseplate 3, the baseplate 3 is likewise provided at that location with an agent which does not bond to the frame material, for example vaseline or tape, before the frame material is moulded on. The retaining feature 20 ensures that the baseplate 3 continues to bear against the window plate 2 even when the entire floor display 1 is lifted, and that the window plate 2 cannot be opened by accident with respect to the baseplate 3. If it is desirable for an image carrier to be arranged between the plates 2, 3 or replaced, the free corner of the baseplate 3 can easily be removed from under the flexible retaining feature 20, after which the window plate 2 can be folded open with respect to the baseplate 3. FIG. 7 clearly reveals this folding-open operation, during which an image carrier 21 can be quickly and easily pushed between the two plates 2, 3. The bonded join between the two peripheral edge sides 10, which are at right angles to one another, of the baseplate 3 and the frame 4 in this case serves as a stop edge while the image carrier 21 is being pushed inwards.

A non-slip profile 22 is moulded onto the underside of the baseplate 3. This non-slip profile is preferably made from the same material as the frame 4 and is moulded on at the same time as the latter. The non-slip profile 22 is composed of a plurality of star shapes and comprises round segments 23 which are partially left open. Additional fixing means, such as hook-and-loop strips, adhesive gum, double-sided adhesive tape, etc., can be arranged in the segments 23. The openings in the segments 23 ensure that the fixing means can easily be removed from them again.

The peripheral edge sides 7 of the baseplate 3 which are not bonded to the frame 4 are advantageously located a short distance above the floor, on account of the shoulder 12 and the non-slip profile 22. As a result, moisture has less opportunity to penetrate into the floor display.

A lip 25, in which a customer-specific logo can be arranged, is provided on the frame 4.

The corners of the window plate 2 are rounded, in particular with a radius of at least 4 mm. This reduces the concentration of stresses between the frame 4 and the plates 2, 3 and prevents the frame 4 from cracking at these corners. The corners of the baseplate 2 are preferably also rounded, with a radius of at least 2 mm. This is more user-friendly when an image carrier is being replaced.

Ribs 27 are provided on the underside of the frame 4 and of the non-slip profile 22. These improve the non-slip properties, which had already been considerably improved by the selection of a less hard frame material. The non-slip profile may also take a different form, for example the ribs may be omitted.

Figure 8:
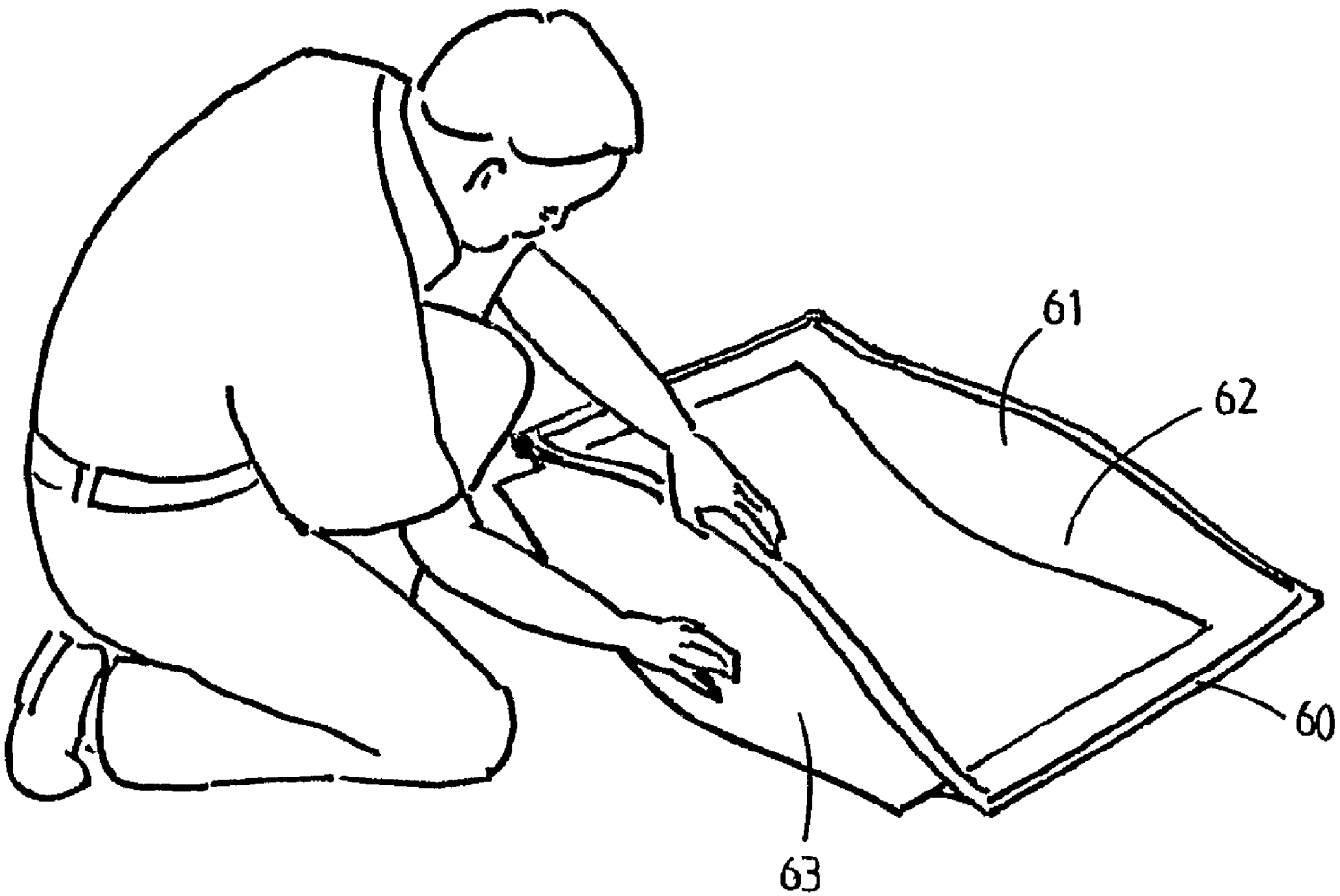
FIG. 8 shows a view corresponding to FIG. 7 of a proposed way of arranging a poster in a variant embodiment of the floor display.

FIG. 8 shows a variant in which a frame 60 made from a flexible material has been bonded to the entire peripheral edge of the window plate 61 and to two opposite peripheral edge sides of a baseplate 62. The remaining two opposite peripheral edge sides of the baseplate 62 are not bonded to the frame. In this case, an image carrier 63 can be inserted by lifting the frame 60 and the window plate 61 with respect to the baseplate 62. This will cause the plates 61, 62 to curve slightly, after which the image carrier 63 can be pushed in from the side.

The length of the plates is preferably at least 800 mm. The width of the frame, as seen from the peripheral edge of the window plate, may, with plates of this dimension, be less than or equal to 10 mm by virtue of the invention, while the thickness of the frame, with plates of these dimensions, may be less than or equal to 5 mm by virtue of the invention. The width of the frame as seen through the window plate and measured from the peripheral edge of the baseplate may, with plates of these dimensions, be less than or equal to 20 mm by virtue of the invention. However, other relationships between the dimensions of the plates and of the frame are also possible.

Numerous variants are possible in addition to the embodiment shown. The bonded join between the frame and the plates may be produced not only by the injection-moulding process described but also in other ways, for example by means of gluing or thermal welding. It is also possible to use other forms of plates and frame and also for the baseplate and window plate to be of substantially the same size. As an alternative to using agent which does not bond to the frame material, such as vaseline or tape, during production, it is also possible to avoid local bonding by the use of inserts. These inserts may be placed in the mould, optionally together with the plates, and in this case are preferably designed to be as thin as possible. In a further variant, it is also possible to provide ribs at suitable locations in the mould, onto which ribs the peripheral edge sides of the baseplate which are not to be bonded to the frame material can be placed.

Therefore, the invention provides a very user-friendly floor display which is economical to produce and easy to maintain. An image carrier can easily be fitted or replaced without detracting from the dimensional stability of the overall assembly. Also, users of, for example, shopping trolleys will consider the floor display to be less of an obstacle, since its height can be lower, and the frame can have a profile which merges with the top side of the window plate.

The invention claimed is:

1. Floor display, comprising:

a window plate (2) made from a transparent material;

a baseplate (3);

a frame (4) out of flexible material;

the frame (4) extending around the two plates (2, 3) and holding them together, it being possible for an exchangeable image carrier (21) made of material in sheet or film form to be placed between the plates (2, 3), the frame (4) being nonreleasably connected, by means of a bonded join, to the entire peripheral edge (9) of the window plate (2), and the frame (4) furthermore being nonreleasably connected, by means of a bonded joint, to at most two peripheral edge sides (10) of the baseplate (3) in which the remaining peripheral edge sides (7) of the baseplate (3) which are not bonded to the frame (4) closely adjoin the frame (4) and in which the frame (4) is moulded on in an injection-moulding process, and in which closely adjoining of the frame (4) and the remaining peripheral edge sides (7) of the baseplate (3) which are not bonded to the frame (4) is obtained by these remaining peripheral edge sides (7) of the baseplate (7), prior to the injection-moulding, being provided with an agent which does not bond to the frame material.

2. Floor display according to claim 1, in which the agent which does not bond to the frame material is vaseline or tape.

3. Floor display, comprising:

a window plate (2) made from a transparent material;

a baseplate (3);

a frame (4) out of flexible material;

the frame (4) extending around the two plates (2, 3) and holding them together, it being possible for an exchangeable image carrier (21) made of material in sheet or film form to be placed between the plates (2, 3), the frame (4) being nonreleasably connected, by means of a bonded join, to the entire peripheral edge (9) of the window plate (2), and the frame (4) furthermore being nonreleasably connected, by means of a bonded joint, to at most two peripheral edge sides (10) of the baseplate (3) in which the remaining peripheral edge sides (7) of the baseplate (3) which are not bonded to the frame (4) closely adjoin the frame (4) and in which the frame (4) is moulded onto the entire peripheral edge of the baseplate (3), both onto that part of the peripheral edge sides of the plates (2, 3) to which the frame (4) is bonded, and onto that part of the plates (2, 3) onto which the frame (4) is not bonded.

4. Floor display according to claim 3, in which the window plate (2) and the baseplate (3) are out of substantially the same material.

5. Floor display according to claim 3, in which the frame (4) is nonreleasably connected, by means of the bonded join, to two peripheral edge sides (10), in particular two adjacent peripheral edge sides (10), of the baseplate(3).

6. Floor display according to claim 3, in which the dimensions of the baseplate (3) are smaller than those of the window plate (2).

7. Floor display according to claim 3, in which the frame (4) is nonreleasably connected, by means of the bonded join, to at least the upright peripheral edge sides (9) of the window plate (2).

8. Floor display according to claim 3, in which the frame (4) is made from a material with a hardness lower than 50 Shore A.

9. Floor display according to claim 3, in which a space (6) is provided between the baseplate (3) and the window plate (2), and this space can advantageously be used in situations in which an image carrier of relatively great thickness needs to be inserted.

10. Floor display according to claim 3, in which at least one retaining feature (20) is provided for retaining at least one of the peripheral edge sides (7) of the baseplate (3) which are not bonded to the frame (4) on the window plate (2).

11. Floor display according to claim 3, in which the retaining feature (20) is moulded on with the frame (4).

12. Floor display according to claim 11, in which non-bonding between the retaining feature (20) and the baseplate (3) is achieved by the baseplate (3) being provided, prior to the moulding operation, and at the location of the retaining feature (20), with an agent which does not bond to the frame material.

13. Floor display according to claim 3, in which the top side of the frame (4) extends at most as far as the top side of the window plate (2), and in particular tapers obliquely downwards.

14. Floor display according to claim 3, in which the plates (2, 3) are at least 80 cm long.

15. Floor display according to claim 3, in which a non-slip profile (22), which is produced from the frame material and in particular is moulded on at the same time as the latter, is provided on the underside of the baseplate (3).

16. Floor Display, comprising:

a window plate (2) made from a transparent material;

a baseplate (3);

a frame (4) out of flexible material;

the frame (4) extending around the two plates (2, 3) and holding them together, it being possible for an exchangeable image carrier (21) made of material in sheet or film form to be placed between the plates (2, 3), the frame (4) being nonreleasably connected, by means of a bonded join, to the entire peripheral edge (9) of the window plate (2), and the frame (4) furthermore being nonreleasably connected, by means of a bonded joint, to at most two peripheral edge sides (10) of the baseplate (3) in which the remaining peripheral edge sides (7) of the baseplate (3) not bonded to the frame (4) closely adjoin the frame (4) and in which the window plate (2), besides being connected, by means of a bonded join, with its peripheral edge (9) to the frame (4) is furthermore supported on the frame (4) by way of a shoulder (14) at its underside.

17. Floor display according to claim 16, in which said shoulder (14) of the frame (4) is bonded to the window plate (2).

18. Floor display, comprising:

a window plate (2) made from a transparent material;

a baseplate (3);

a frame (4) out of flexible material;

the frame (4) extending around the two plates (2, 3) and holding them together, it being possible for an exchangeable image carrier (21) made of material in sheet or film form to be placed between the plates (2, 3), the frame(4) being nonreleasably connected, by means of a join, to the entire peripheral edge (9) of the window plate (2), and the frame (4) furthermore being nonreleasably connected, by means of a bonded joint, to at most two peripheral edge sides (10) of the baseplate (3) in which the remaining peripheral edge sides (7) of the baseplate (3) which are not bonded to the frame (4) closely adjoin the frame (4) and in which the baseplate (3) at the location of its bonded peripheral edge sides (10), is furthermore supported on the frame (4) by way of a shoulder (12) at its underside.

19. Floor display according to claim 18, in which said shoulder (12) of the frame (4) is bonded to the baseplate (3).

20. Floor display according to claim 18, in which the baseplate (3) at the location of its remaining peripheral edge sides (7) which are not bonded to the frame (4) is not delimited at its underside by the frame (4).

* * * * *

UNITED STATES PATENT AND TRADEMARK OFFICE

CERTIFICATE OF CORRECTION

PATENT NO. : 8,181,376 B2
APPLICATION NO. : 11/568184
DATED : May 22, 2012
INVENTOR(S) : Matthijs Alfons Rietveld It is certified that error appears in the above-identified patent and that said Letters Patent is hereby corrected as shown below:

On the Title Page:

"(75) Inventor: Matthijs Alphons Rietveld" should be -- (75) Inventor: Matthijs Alfons Rietveld --;

"(73) Assignee: Comax B.V. Delfi" should be -- (73) Assignee: Comax B.V. Delft --;

Column 3, line 52, "widow" should be -- window --;

Column 9, Claim 18, lines 5 and 6, "by means of a join" should be -- by means of a bonded join --.

Signed and Sealed this
Thirteenth Day of November, 2012

David J. Kappos

David J. Kappos
*Director of the United States Patent and Trademark Office*